United States Patent [19]

Davcev

[11] Patent Number: 5,023,575

[45] Date of Patent: Jun. 11, 1991

[54] COAXIAL ANTENNA SELECTOR MATRIX

[75] Inventor: Stojan Davcev, Skopie, Yugoslavia

[73] Assignee: Asea Brown Boveri Ltd., Baden, Switzerland

[21] Appl. No.: 354,369

[22] Filed: May 19, 1989

[30] Foreign Application Priority Data

Jun. 8, 1988 [CH] Switzerland ..... 2179/88

[51] Int. Cl.[5] ..... H01P 1/12

[52] U.S. Cl. ..... 333/105; 200/504

[58] Field of Search ..... 333/105, 101, 262; 200/504; 335/4, 5

[56] References Cited

U.S. PATENT DOCUMENTS

| | | | |
|---|---|---|---|
| 2,519,933 | 8/1950 | Rouault | 174/21 |
| 3,215,954 | 11/1965 | Stevens | 333/105 |
| 3,593,206 | 7/1971 | Schimann et al. | 333/105 |
| 3,873,794 | 3/1975 | Owen | 200/504 X |

FOREIGN PATENT DOCUMENTS

| | | | |
|---|---|---|---|
| 0003463 | 8/1979 | European Pat. Off. . | |
| 0044099 | 1/1982 | European Pat. Off. . | |
| 1020890 | 5/1983 | U.S.S.R. | 333/101 |
| 805684 | 12/1953 | United Kingdom | 200/504 |
| 927388 | 5/1963 | United Kingdom . | |
| 2127369 | 4/1984 | United Kingdom . | |

*Primary Examiner*—Eugene R. Laroche
*Assistant Examiner*—Benny Lee
*Attorney, Agent, or Firm*—Oblon, Spivak, McClelland, Maier & Neustadt, P.C.

[57] ABSTRACT

In a coaxial antenna selector having a plurality of input lines and a plurality of output lines, a reduction in switching and control expenditure and in the crosstalk sensitivity is achieved due to the fact that each of the lines is associated with a coaxial moving link element which allows a direct connection to be established between an arbitrary transmitter and an arbitrary antenna.

In the simplest case, the link elements are constructed as telescopically extendable extensions of the input and output lines.

9 Claims, 6 Drawing Sheets

COAXIAL ANTENNA SELECTOR MATRIX

BACKGROUND OF THE INVENTION

1. Field of the invention

The present invention relates to the field of transmission engineering. In particular, it relates to a coaxial antenna selector comprising

- a plurality of coaxial input lines for feeding in an RF power of corresponding transmitters;
- a plurality of coaxial output lines for delivering the RF power to corresponding antennas;
- each input line being optionally connectable to each output line.

Such an antenna selector is known, for example, from EP-B1 0 044 099.

2. Discussion of background

In large-scale broadcasting transmission systems, particularly in the short-wave field, a plurality of independently operating individual transmitters is used which radiate the amplitude-modulated carrier signal via different antennas depending on the time of day and the program.

The RF power which in most cases is within the range of several 100 kW is fed into the respective antenna from the respective transmitter via coaxial lines (50 ohm) with high ratings.

To provide the possibility of rapidly and flexibly setting up a connection between the individual transmitters and antennas, a coaxial antenna selector is arranged between the two with the aid of which any desired connection between an arbitrary transmitter and an arbitrary antenna can be switched within a short time.

Known coaxial antenna selectors are constructed in accordance with the matrix principle (EP-B1 0 044 099). In these matrix selectors, the input lines coming from the transmitters form the rows and the output lines going off to the antennas form the columns of a matrix.

At the nodes of the matrix, coaxial change-over switches are arranged in pairs which connect through the respective row or column line in one switch position and disconnect both lines and connect diagonally in the node in the other switch position.

It follows from this, on the one hand, that in the case of n transmitters and m antennas, that is to say in the case of an $(n \times m)$ matrix, $2 \times n \times m$ change-over switches are needed, all of which require a separate drive and separate control.

On the other hand, the diagonal switching-over leaves in the antenna selector of the conventional type lines with open ends in which high voltages can be induced during operation which lead to interference in the system if not additional countermeasures are taken (so-called crosstalk).

Finally, the large number of change-over switches which are located in a switched-through connection leads to a correspondingly large number of contact points in the line connection which naturally represent weak points.

SUMMARY OF THE INVENTION

It is therefore the object of the present invention to create a coaxial antenna selector which is distinguished by a distinctly lower circuit and control expenditure, exhibits fewer contact points and a lower crosstalk sensitivity.

In a coaxial antenna selector of the type initially mentioned, the object is achieved by the fact that

- each input line and each output line is in each case associated with a single moving link element in form of a coaxial line; which coaxial line
- is connected with the one line end to the associated input and output line; and
- can be displaced along an associated displacement line with the other open line end; in such a manner that
- each displacement line of a link element associated with an input line intersects all displacement lines of the link elements associated with the output lines.

The core of the invention thus lies in directly connecting the associated input and output lines in the antenna selector with one another with the aid of a moving line section for each switched-through connection between a transmitter and an antenna. There are therefore no longer any change-over switches associated with the matrix node but only moving link elements which are associated with the respective input and output lines (that is to say only $(n+m)$ link elements) which must be driven and controlled. The number of crosstalk-sensitive line sections within the antenna selector is thus also correspondingly reduced.

According to a first preferred illustrative embodiment of the invention, all displacement lines are straight lines, the displacement lines of the link elements associated with the input lines extend in parallel with one another and perpendicularly to the displacement lines of the link elements associated with the output lines, and the link elements are in each case constructed as telescopically extendable extensions of the input and output lines (FIG. 4).

This type of antenna selector can be implemented in a particularly simple manner because in this case only linear displacements occur, that is to say neither swivel nor ball joints are required.

Further illustrative embodiments are obtained from the subclaims.

BRIEF DESCRIPTION OF THE DRAWINGS

A more complete appreciation of the invention many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
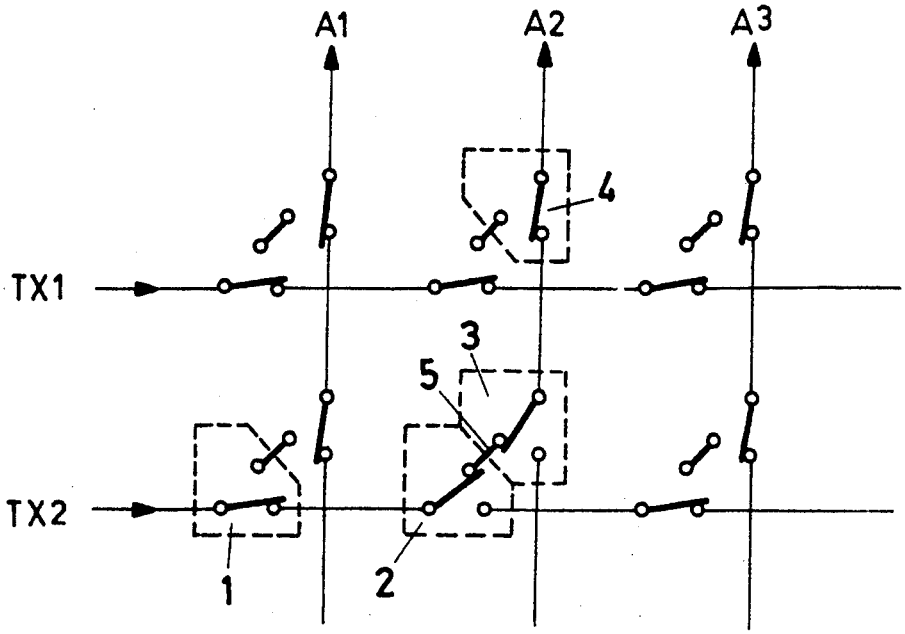
Fig.1 PRIOR ART
FIG. 1 shows an antenna selector matrix with paired change-over switches in accordance with the prior art.

Referring now to the drawings, wherein like reference numerals designate identical or corresponding parts throughout the several views, in FIG. 1 the arrangement of a conventional coaxial antenna selector is reproduced for a (2×3) matrix. The antenna selector has two inputs for connecting two transmitters TX1 and TX2 and three outputs for connecting three antennas A1, A2

Correspondingly, there are two coaxial input lines (rows of the matrix) and three coaxial output lines (columns of the matrix) which intersect at six nodes.

At these points of intersection, pairs of change over switches are in each case provided, four of which (1, . . . , 4) are highlighted by a dashed frame.

One change-over switch (2) within such a pair of change-over switches (2, 3) is inserted into the associated input line.

The change-over switches 1, . . . , 4 in each case have two switch positions: in one switch position (in FIG. 1 in the change-over switches 1 and 4), the coaxial lines into which the change-over switches are inserted are connected through.

In the other switch position (in the change-over switches 2 and 3), the coaxial lines are disconnected and are diagonally connected by means of an additional conductor line 5 at the point of intersection. In the example of FIG. 1, the antenna A2 is connected in this manner to the transmitter TX2.

As can be easily seen, 12 change-over switches are already needed for this small-sized (2×3) matrix, all of which must be driven by motor and controlled.

Furthermore, the switched connection between transmitter TX2 and antenna A2 in the example of FIG. 1 contains, due to the fact that the change-over switches 1, . . . , 4 are used for this connection, at least eight contact points (two contact points per change-over switch) which are susceptible because of the high mechanical and electrical loading and form weak points in the link.

Finally, conductor pieces with open ends, which promote crosstalk and thus interference to the operation, always remain in the known antenna selector.

Figure 2:
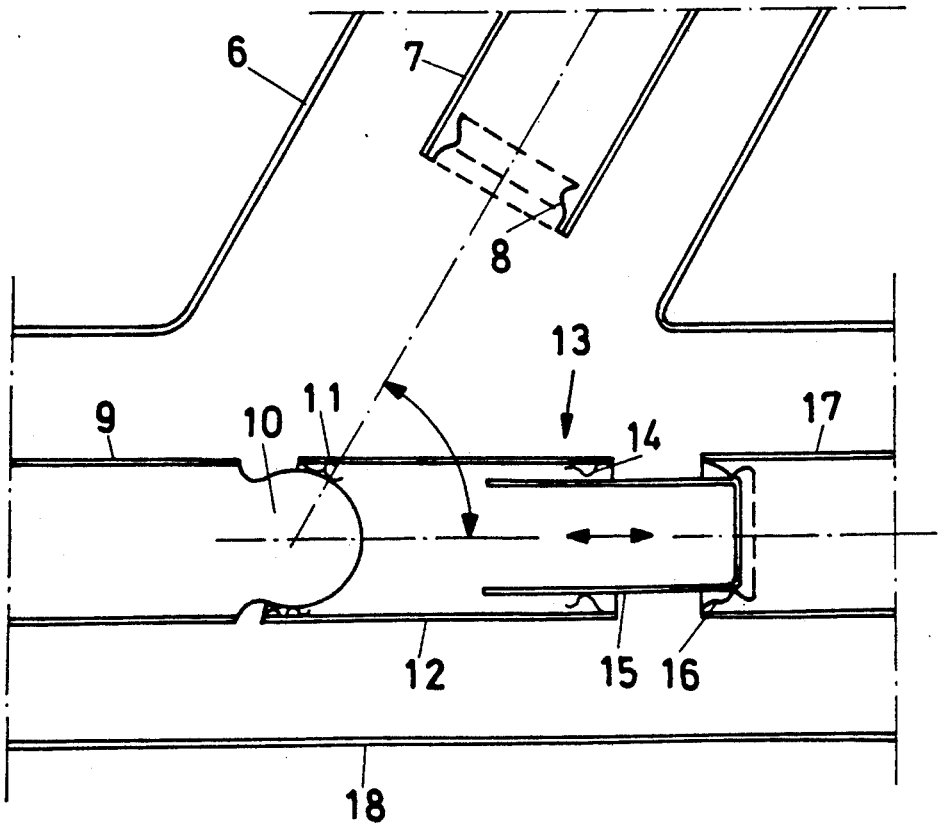
Fig. 2 PRIOR ART
FIG. 2 shows the construction of a change-over switch from FIG. 1.

The internal construction of a known change-over switch is shown in FIG. 2. The change-over switch naturally is of coaxial design, that is to say it comprises inner conductors 9, 17 and outer conductor 18 in the direction of conduction and inner conductor 7 and outer conductor line 6 in the branch.

For switching-over, a link element 13 is provided in the internal area of the line which consists of an outer tube 12 and an inner tube 15.

The outer tube 12 is pivotably attached with its one end to a joint ball 10 which is located at the end of one inner conductor 9. The inner tube 15 can be telescopically displaced in the outer tube 12. Outer tube 12 and joint ball 10 and inner tube 15 and outer tube 12 are in each case electrically connected to one another by means of a tulip contact 11 and 14.

Further tulip contacts 8 and 16 are in each case attached to the ends of the inner conductors 7 and 17 and establish the connection to the inner tube 15 in the respective switch position.

For the rest, the actual technical construction of such a change-over switch and of a matrix produced by means of the change-over switches can be seen in publication no. CH-E 3.10559.2 E by Messrs. BBC Brown Boveri AG, Baden (Switzerland).

Figure 3:
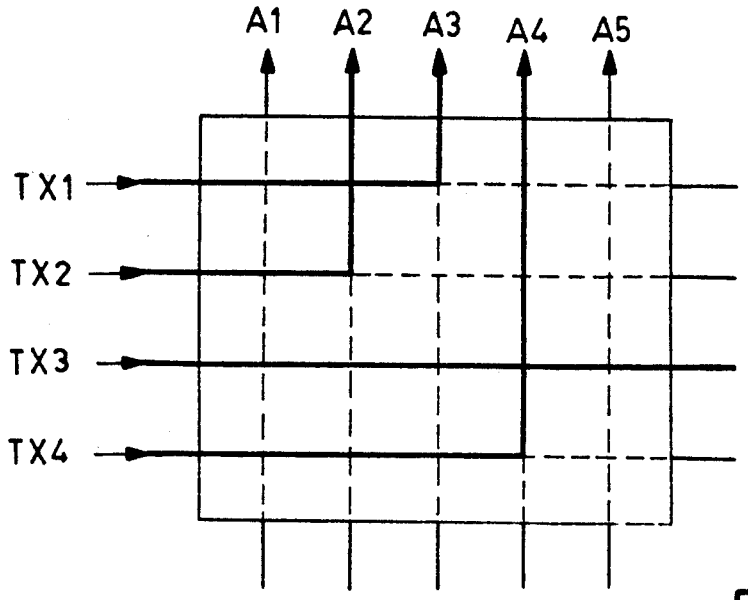
FIG. 3 shows the basic arrangement of the direct setting up of a connection in an antenna selector according to the invention.

Whilst the switched connection passes via a plurality of individual change-over switches in a conventional antenna selector, the respective input and output lines are directly connected in the antenna selector according to the invention as is shown in the example of a (4×5) matrix in FIG. 3. The switched connections transmitter TX1—antenna
transmitter TX2—antenna A2
transmitter TX4—antenna A4 are here marked by the continuous lines. The dashed lines only shown possible other line paths without lines actually going that way in this switch condition.

Figure 4:
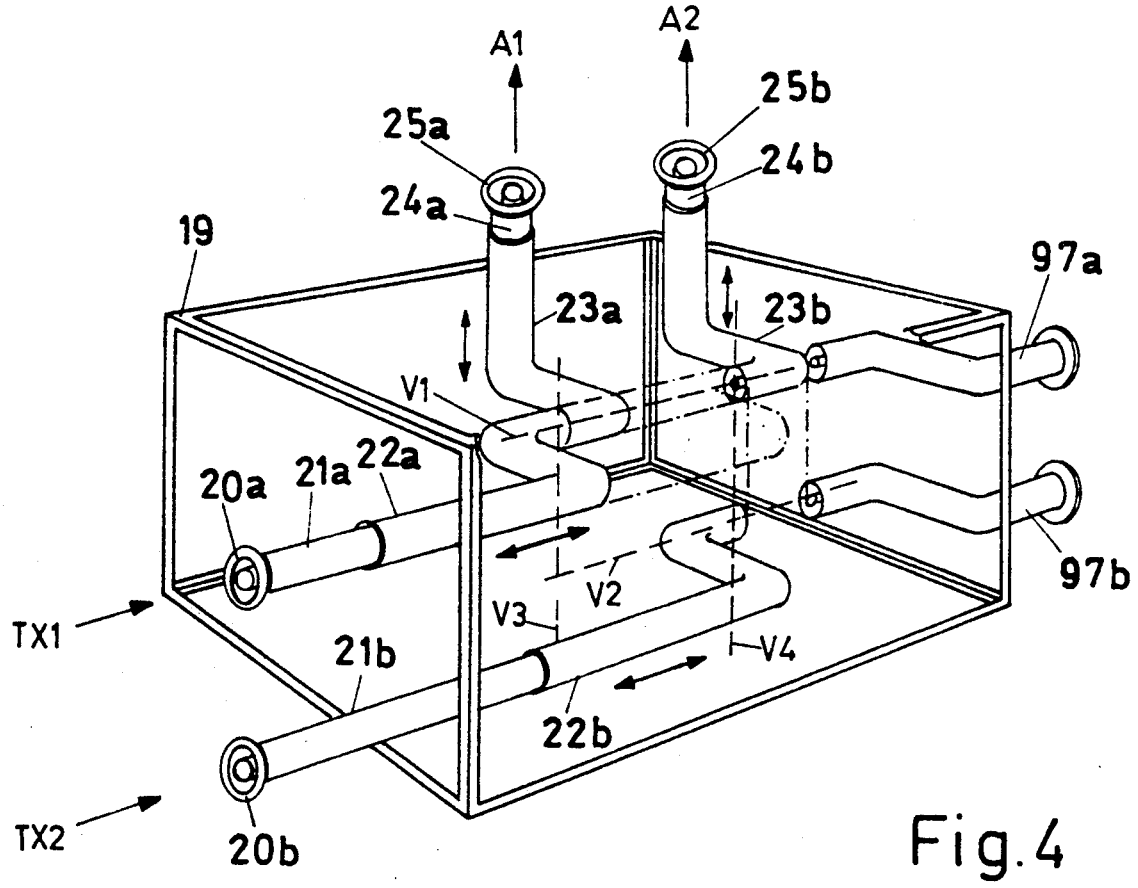
FIG. 4 shows a first illustrative embodiment of a coaxial antenna selector according to the invention with telescopically extendable link elements.
Figure 5:
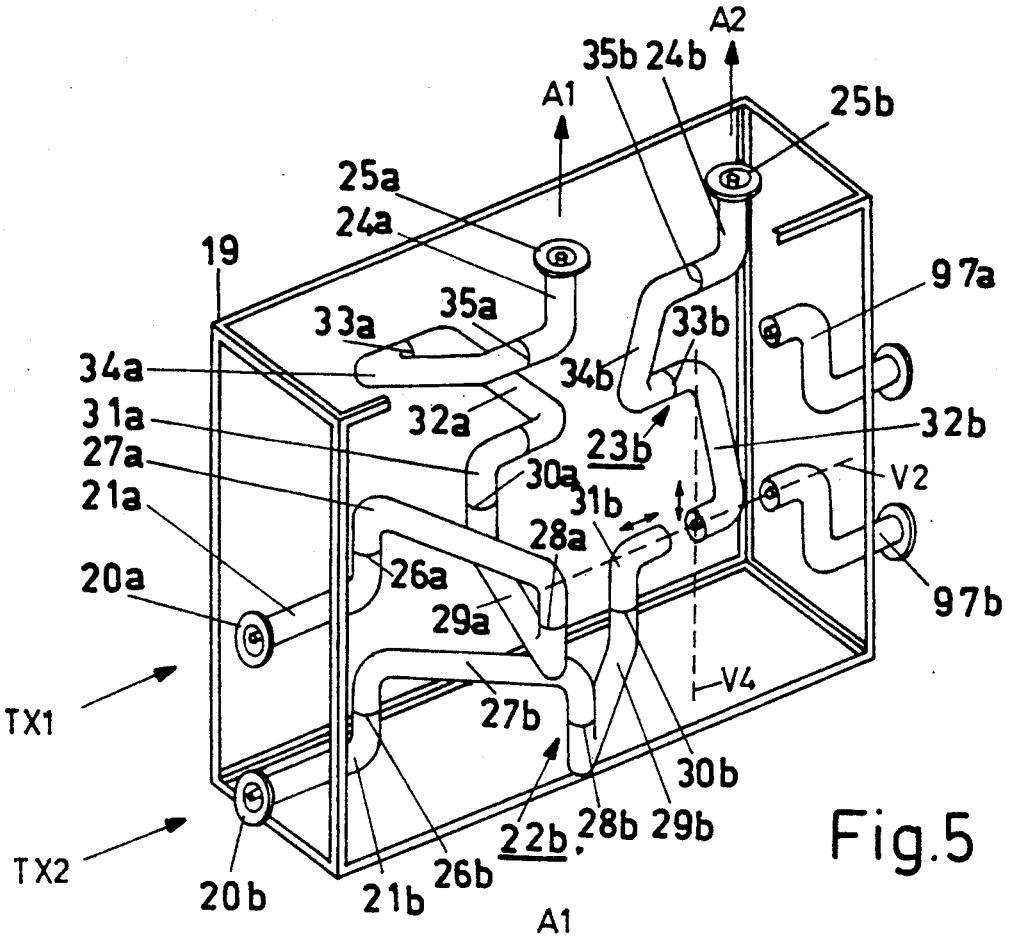
FIG. 5 shows a second illustrative embodiment analogously to FIG. 4 with link elements consisting of several line elements connected via swivel joints.
Figure 7:
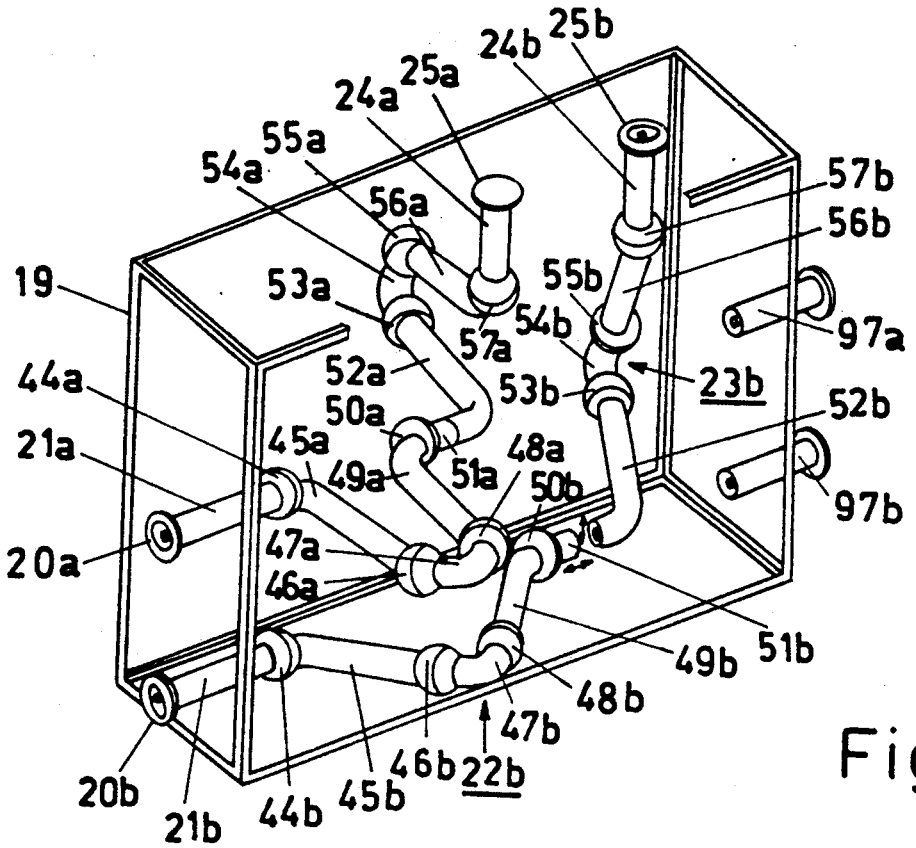
FIGS. 7, 8 shows further illustrative embodiments corresponding to FIGS. 5 and 6 in which ball joints are used instead of the swivel joints.

Various embodiments of the invention, which have a matrix arrangement as a common basis, are shown in FIGS. 4, 5 and 7.

In these embodiments, a plurality of coaxial input lines 21*a*,21*b* and output lines 24*a*,24*b* are permanently, arranged in a frame structure 19. The input lines, 21*a*, 24*b* extend in parallel with one another and perpendicularly to the output lines 24*a*, 24*b* which are also parallel.

Each input and output line 21*a*, 21*b* and 24*a*, 24*b*, respectively, is associated with a single moving link element 22*a*, 22*b* and 23*a*, 22*b* respectively. The link elements 22*a*, 22*b* and 23*a*, 22*b* also have the form of a coaxial line and are connected with one line end to the associated input and output line 20*a*, 20*b* and 24*a*, 23*b* respectively.

The other open line end of the link elements 22*a*, 22*b* and 23*a*, 23*b* can be displaced along an associated displacement line V1, . . . , V4 (FIG. 4).

All displacement lines V1, . . . , V4 are located in one plane. The displacement lines V1, V2 of the link elements 22*a*, 22*b* associated with the input lines 21*a*, 21*b* extend parallel with one another and perpendicularly to the parallel displacement lines V3, V4 of the link elements 23*a*, 23*b* associated with the output lines 24*a*, 23*b*.

If then, for example, antenna A2 is to be connected to transmitter TX2, the link elements 22*b* and 23*b* of the input line 21*b* and output line 24*b* are displaced along their displacement line V2 and V4, respectively, up to the point of intersection of these lines.

Since the open ends of the link elements 22*b* and 23*b* are constructed in such a manner that they are directly opposite one another in this position, a continuous coaxial connection from transmitter TX2 to antenna A2 is established in this manner.

Other connections between a transmitter and an antenna can be switched when the corresponding link elements are brought into contact with the open line ends at the corresponding other points of intersection of their displacement lines.

The moving link elements 22*a*, 22*b* and 23*a*, 23*b* can be produced in various manners. In the illustrative embodiment of FIG. 4, the link elements 22*a*, 22*b* and 23*a*, 23*b* are constructed as telescopically extendable extensions of the input and output lines 22*a*, 22*b* and 24*a*, 24*b*, respectively.

The extensions are bent several times at right angles at the open ends so that the displacement lines V1,. . ., V4 extend in a plane which lies between the planes of the input lines 21*a*, 21*b* and output lines 24*a*, 24*b*. In this manner, all possible connections between transmitters TX1, TX2 and antennas A1, A2 can be switched without obstruction.

For the connection of the transmitters TX1, TX2, the input lines 21*a*, 21*b* have flange-like transmitter connections 20*a*, 20*b* in this example. The antennas A1, A2 are connected via corresponding antenna connections 25*a*, 25*b* at the output lines 24*a*, 24*b*.

It is also possible, as shown in FIGS. 4, 5 and 7, to provide additional output lines 97*a*, 97*b* which are opposite the input lines 21*a*, 21*b* and can also be connected to the input lines 21*a*, 21*b* via the link elements 22*a*, 21*b*. These additional output lines 97*a*, 97*b* can be used, for example, for further antennas or as line terminations.

As an alternative to constructing the link elements 22*a*, 22*b* and 23*a*, 23*b* as telescopically extendable extensions according to FIG. 4, the link elements can be assembled, as shown in the illustrative embodiment of FIG. 5, in each case of at least two successive line elements 27*a*, 29*a* and 27*a*, 29*b* and 32*a*, 34*b* and 32*a*, 34*b* which are in each case connected to one another via a first swivel joint 28*a*, 28*b*; 33*a*, 33*b* and are connected to the associated input and output line 21*a*, 21*b* and 24*a*, 24*b*, respectively, via a second swivel joint 26*a*, 26*b*; 35*a*, 35*b*.

The axes of rotation of all swivel joints 26*a*, 26*b*; 28*a*, 28*b*; 33*a*, 33*b*; 35a,b are in each case perpendicular to the center axis of the associated input and output lines 21*a*, 21*b* and 24*a*, 24*b*, respectively.

Due to the fact that there are two perpendicular swivel joints per link element, the same displacement lines as in the example of FIG. 4 are implemented for the open line ends.

To make it easier to match the open line ends when they are switched together, because of the bending movement of the link elements 22*a*, 22*b* and 23*a*, 23*b*, a further line element 31*a*, 31*b* bent at right angles and having a further swivel joint 30*a*, 30*b* is also in each case provided at the input-side link elements 22*a*, 22*b* in the arrangement according to FIG. 5 (but both can just as well be arranged at the output-side link elements 23*a*, 23*b*).

FIG. 7 shows a further alternative. In this case, instead of the perpendicular swivel joints in the link elements 22*a*, 22*b* and 23*a*, 23*b*, ball joints 44*a*, 46*a*, 48*a*; 44*b*, 46*b*, 48*b*; 53*a*, 55*a*, 57*a*; 53*b*, 55*b*, 57*b* are use which connect at least three successive line elements 45*a*, 47*a*, 49*a*; 45*b*, 47*b*, 49*b*; 52*a*, 54*a*, 56*a*; 52*b*, 54*b*, 56*b* per link element and connect them to the associated input and output line 21*a*, 21*b* and 24*a*, 24*b*.

In this case, an additional line element and ball joint is provided for each link element, compared with FIG. 5, because the coaxially constructed ball joints only provide for a restricted angle of rotation.

In the illustrative embodiment of FIG. 7, the line elements 51*a*, 51*b* and the ball joints 50*a*, 50*b*, which provide for better matching of the open line ends when connected together, correspond to the line elements 31*a*, 31*b* and the swivel joints 30*a*, 30*b* in FIG. 5.

Figure 6:
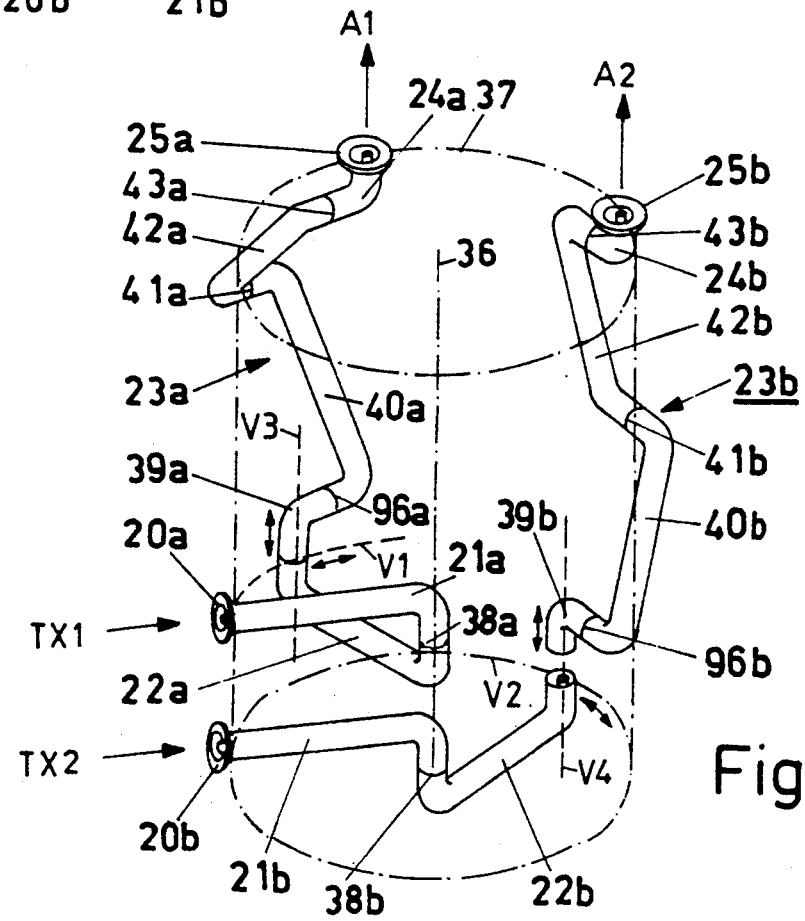
FIG. 6 shows a third illustrative embodiment in which the link elements are partially constructed to be linearly displaceable and partially to be rotatable.
Figure 8:
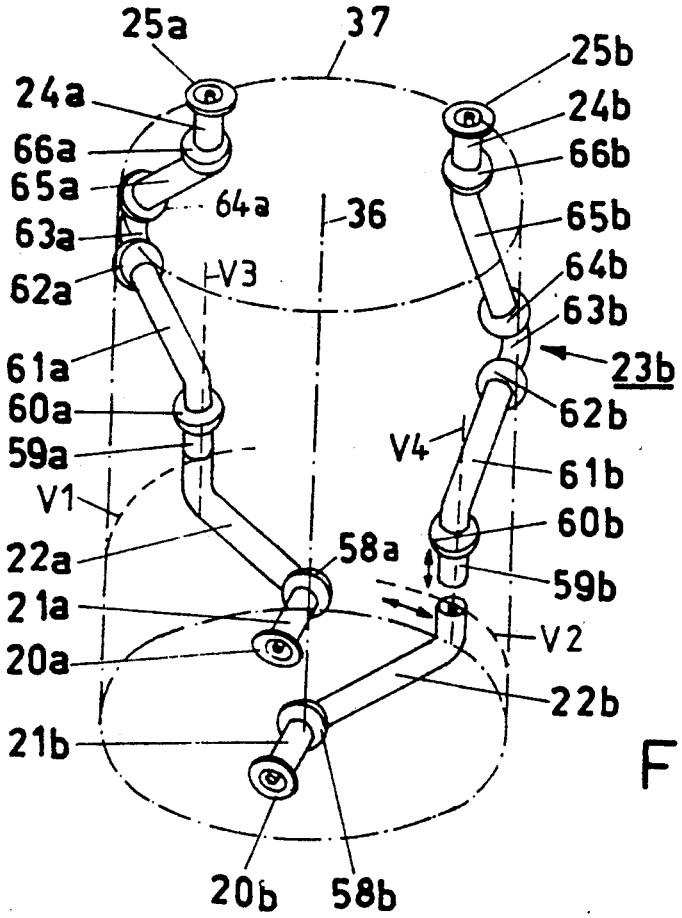

Whilst in the previous illustrative embodiments of FIGS. 4, 5 and 7, perpendicularly intersecting straight lines were used as displacement lines V1, . . ., V4 which were located in a common plane, the illustrative embodiments reproduced in FIGS. 6 and 8 exhibit as displacement lines straight lines and circles which extend in a common cylinder surface 37.

Here, too, the input lines 21*a*, 21*b* are arranged in parallel above one another and end in the cylinder axis 36 of the cylinder surface 37.

The input-side link elements 22*a*, 22*b* in each case comprise at least one line element which is connected to the associated input line 21*a*, 21*b* via a first swivel joint 38*a*, 38*b* located in the cylinder axis 36 (FIG. 6).

Since the axes of rotation of the swivel joints 38*a*, 38*b* are perpendicular to the center axes of the input line 21*a*, 21*b* and coincide with the cylinder axis 36, the corresponding displacement lines V1, V2 form parallel circles in the cylinder surface 37.

The output-side link elements 23*a*, 23*b* again comprise in each case at least two successive line elements 40*a*, 42*a* and 40*b*, 42*b* which are mutually connected via a second swivel joint 41*a*, 41*b* and are connected to the associated output line 24*a*, 21*b* via a third swivel joint 43*a*, 43*b*. With this configuration, which is analogous to FIG. 5, the corresponding displacement lines V3, V4 are straight lines which extend in parallel with the cylinder axis 36 in the cylinder surface 37 and intersect the circular displacement lines V1, V2 at right angles.

Here, too, additional line elements 39*a*, 39*b* and swivel joints 96*a*, 96*b* ensure an improved match for the line ends.

The transition from the illustrative embodiment of FIG. 6 to the illustrative embodiment of FIG. 8 is the same as the transition from FIG. 5 to FIG. 7: in this case, too, the swivel joints are replaced by ball joints 58*a*, 58*b*; 60*a*, 58*b*; 62*a*, 62*b*; 64*a*, 64*b* and 66*a*, 66*b*. The output-side link elements 23*a*, 23*b* then comprise the line elements 59*a*, 59*b*; 61*a*, 61*b*; 63*a*, 63*b* and 65*a*, 65 *b* with one additional line element per link element for the reasons already mentioned above.

In the input-side link elements 22*a*, 22*b*, an additional line element can be omitted since the restricted swivelling range of the ball joints 58*a*, 58*b* is sufficient in this case.

Compared with the embodiment with telescopic mechanism (FIG. 4), the embodiments with swivel joint (parallelepiped according t FIG. 5 and cylinder according to FIG. 6) have the advantage that no line pieces sliding within one another need to be used. In addition, the operating area, that is to say the area in which the displacements occur, is reduced whilst the constructional volume of the antenna selector remains approximately the same.

Constructional volume and operating area are in each case particularly small in the embodiments with ball joint (FIGS. 7, 8).

Even though a (2×2) matrix has always only been considered in the illustrative embodiments, the principles shown can naturally be easily applied to larger matrices.

Compared with the previously known coaxial antenna selector, the advantages are here:

saving of drive systems and control elements;
very few contact points;
no open line pieces, thus no mutual coupling (cross-talk);
simple control; and
simple maintenance.

In the antenna selectors according to FIGS. 5 to 8, ball joints and swivel joints are used for the flexible link elements 22*a*, 22*b* and 23*a*, 23*b*.

Figure 9:
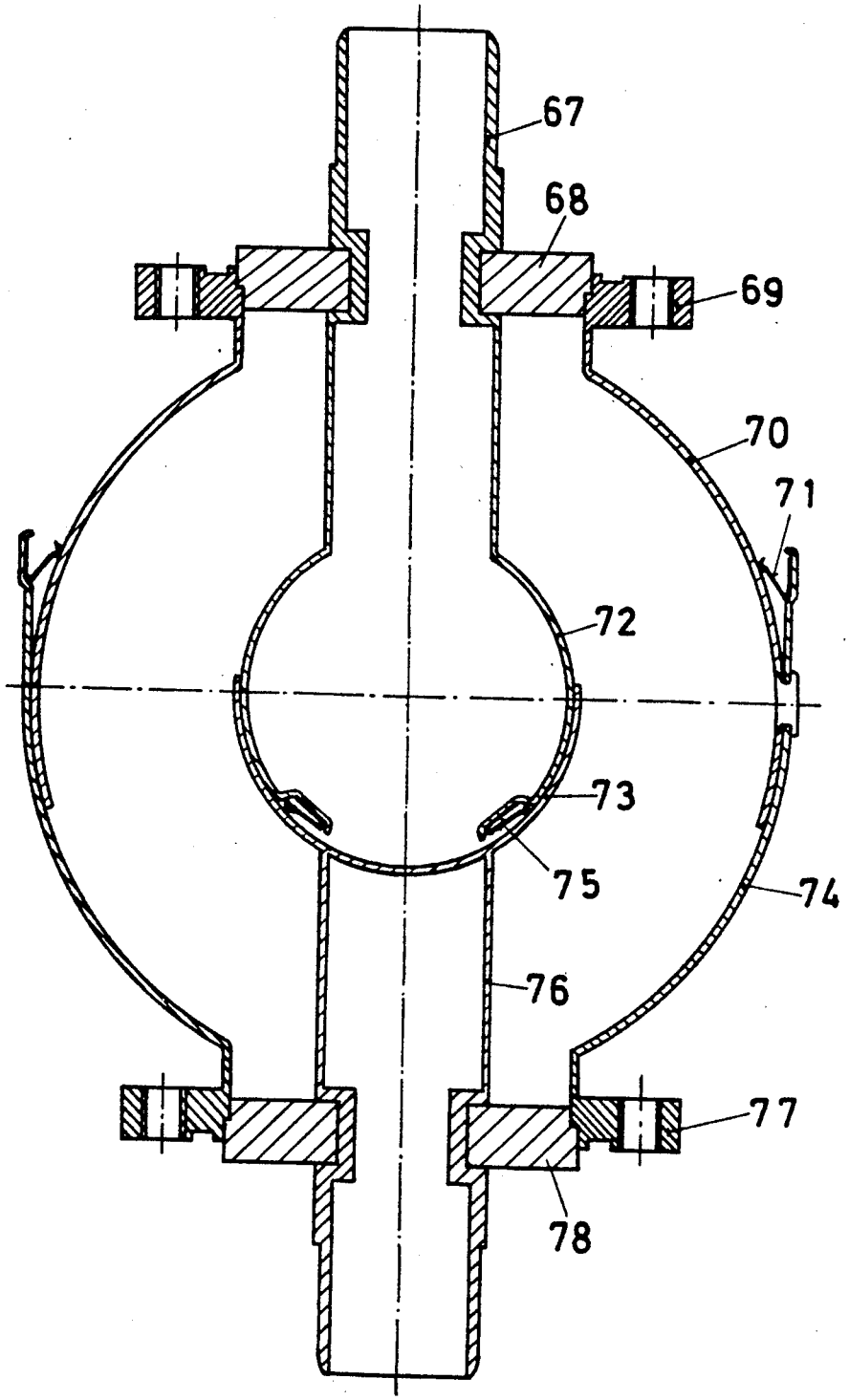
FIG. 9 shows an illustrative embodiment for such a ball joint.
Figure 10:
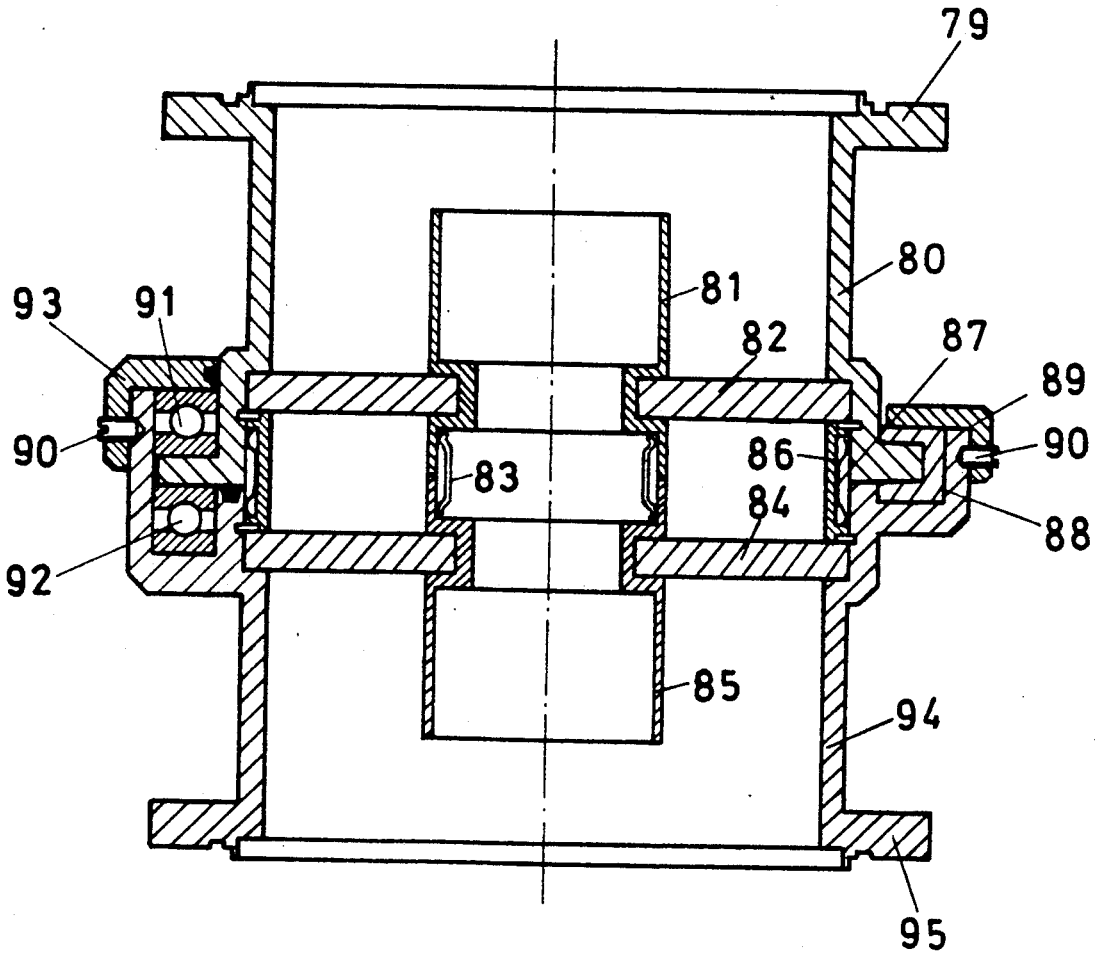
FIG. 10 shows an illustrative embodiment of a swivel joint from FIG. 5 and 6.

Examples of such ball and swivel joints are reproduced in FIGS. 9 and 10.

The ball joint of FIG. 9 is of coaxial construction and comprises two inner conductors 67,76 which become two inner spherical shells 72,73 in the interior of the joint. The two spherical shells 72,73 are placed inside one another and form a universally rotatable joint with ball and socket. A reliable electric connection between the spherical shells 72,73 is achieved by a contact spring 75 arranged between them.

For the outer conductor, flanges 69,77 are provided on both sides of the joint which become corresponding spherical shells 70,74 with a corresponding contact spring 71. The inner conductors 67,76 are supported by means of insulating rings 68,78 at the flanges 69,77.

FIG. 10 shows two variants of a suitable swivel joint. Both variants comprise two inner conductors 81, 85 and two outer conductors 80,94 which abut in the joint are conductively connected at this point by means of contact springs 83,87.

The outer conductors 80,84 also become flanges 79,95 at the ends of the joint and also carry insulating rings 82,84 in the interior which fix the inner conductors 81,85 in location.

At the junction between the two outer conductors 80,94, one outer conductor 94 overlaps the flange-like end of the other outer conductor.

In one variant (on the left of the dot-dashed center line), two ball bearings 91,92, which rotatably support one outer conductor 80 in the other outer conductor 94, are inserted in this part of the joint.

In the other variant (on the right of the center line), a guide ring 88, which encompasses the flange-like end of the outer conductor 80, handles this task.

In both variants, the swivel connection is secured by a collar ring 93,89 which holds the ball bearings 91,92 or the guide ring 88 in their position and is held by grub screws 90. For the contact spring 87 of the outer conductors 80,94, a spring carrier 86 is also provided which holds the spring in its position between the insulating rings 82,84.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A coaxial antenna selector comprising:

a plurality of coaxial input lines for feeding-in RF power from corresponding RF transmitters;

a plurality of coaxial output lines for delivering the RF power to corresponding antennas; and means for connecting any one of said input lines to any one of said output lines;

wherein each input line is associated with a single moving input line link element in the form of a coaxial line with a first line end and a second line end;

wherein each output line is associated with a single moving output line link element in the form of a coaxial line with a first line end and a second line end;

wherein each input line link element is electrically and movably connected at said first line end to the associated input line;

wherein each output line link element is electrically and movably connected at said first line end to the associated output line;

wherein each of said input line link elements is movable with said second line end along an associated first geometrical displacement line;

wherein each of said output line link elements is movable with said second line end along an associated second geometrical displacement line; and wherein each of said first displacement lines intersects each of said second displacement lines thereby making up a plurality of line crosses; such that if any input line link element and any output line link element are moved with said second line end along their respective first and second displacement lines and meet at a line cross, they electrically contact each other with said respective second line ends.

2. The antenna selector as claimed in claim 1, wherein:

all displacement lines are straight lines; and said first displacement lines extend parallel with one another and perpendicularly to said second displacement lines.

3. The antenna selector as claimed in claim 2, wherein:

the link elements respectively comprise at least three successive line elements;

the line elements of each link element are respectively connected to one another via two ball joints; and one line element of each link element is connected to one of an associated input and output line at said first line end via a third ball joint.

4. The antenna selector as claimed in claim 2, wherein the input line and output line link elements are constructed as telescopically extendable extensions of the input and output line, respectively.

5. The antenna selector as claimed in claim 2, wherein;

each of the link elements respectively comprise at least two successive line elements;

each of the line elements of each link element are respectively connected to one another via a first swivel joint; and one line element of each link element is connected to one of an associated input and output line at said first line end via a second swivel joint.

6. The antenna selector as claimed in claim 1, wherein:

all displacement lines are lines on a common cylinder surface having a cylinder axis;

said first displacement lines have a circular configuration with a circle axis oriented parallel to said cylinder axis; and said second displacement lines are straight lines.

7. The antenna selector as claimed in claim 1, wherein:

all displacement lines are lines on a common cylinder surface having a cylinder axis;

said second displacement lines have a circular configuration oriented perpendicular to said cylinder axis; and said first displacement lines are straight lines.

8. The antenna selector as claimed in one of the claims 6 and 7, wherein:

each of the link elements, the displacement lines of which have a circular configuration, comprise at least one line element which is connected at said first line end via a first swivel joint to one of an associated input and output line; and each of the link elements, the displacement lines of which are straight lines, comprise at least two successive line elements which are connected to one another via a second swivel joint and are connected at said first line end to one of an associated output and input line via a third swivel joint.

9. The antenna selector as claimed in one of the claims 6 and 7, wherein:

each of the link elements, the displacement lines of which have a circular configuration, comprise at least one line element which is connected at said first line end to one of an associated input and output line via a first ball joint; and each of the link elements, the displacement lines of which are straight lines, comprise at least three line elements which are connected to one another via two further ball joints and are connected at said first line end to one of an associated output and input line via a further ball joint.

* * * * *